US007819355B2

(12) United States Patent
Prittie

(10) Patent No.: US 7,819,355 B2
(45) Date of Patent: Oct. 26, 2010

(54) WEB INSPECTION AND REPAIR MACHINE WITH RETRACTABLE INSPECTION ZONE

(75) Inventor: Allan R. Prittie, Toronto (CA)

(73) Assignee: Prittie Family Trust 89, Toronto, Ontario (CA)

( * ) Notice: Subject to any disclaimer, the term of this patent is extended or adjusted under 35 U.S.C. 154(b) by 794 days.

(21) Appl. No.: 11/703,090

(22) Filed: Feb. 7, 2007

(65) Prior Publication Data

US 2007/0187020 A1 Aug. 16, 2007

Related U.S. Application Data

(60) Provisional application No. 60/771,041, filed on Feb. 8, 2006.

(51) Int. Cl.
*B65H 18/08* (2006.01)

(52) U.S. Cl. ..... 242/538.2; 226/118

(58) Field of Classification Search ..... 242/538.2, 242/552; 226/118, 119
See application file for complete search history.

(56) References Cited

U.S. PATENT DOCUMENTS 3,733,230 A 5/1973 Prittie
3,927,844 A 12/1975 Bond et al.
4,094,474 A 6/1978 Stollenwerk et al.
4,281,803 A * 8/1981 Massey ..... 242/552
5,474,248 A 12/1995 Bradshaw et al.
5,727,748 A 3/1998 Prittie

FOREIGN PATENT DOCUMENTS

EP 0827927 11/2001

* cited by examiner

*Primary Examiner*—William A Rivera
(74) *Attorney, Agent, or Firm*—Michael I. Stewart; Sim & McBurney

(57) ABSTRACT

A web processing machine permitting inspection and repair of a roll of web material includes an inspection zone vertically juxtaposed to a splicing zone. The inspection zone is structured to be removed from the juxtaposed position to a retracted position in which the splicing zone is exposed to permit an operator to perform a modification of the web without having to substantially move physically from the position in which the operator was located to perform inspection while the machine is running.

8 Claims, 8 Drawing Sheets

WEB INSPECTION AND REPAIR MACHINE WITH RETRACTABLE INSPECTION ZONE

FIELD OF INVENTION

This invention relates generally to web inspection and converting machines which are adapted to perform various process steps on an elongate web. The machine typically has an unwind mandrel and a rewind mandrel, and the web, which is provided initially in the form of a coil or roll of web material which can be fitted on the unwind mandrel. The web is then strung through various possible combinations of devices, such as idler rolls, error detectors, splicers, die cutters, print heads, web slitters and sheeters. Slitting the web may be required for a sequence of images, with two or more images located across the web. Inspection of the moving web can be done electronically or visually with the assistance of a stroboscope, or vision or video system that samples the moving web.

BACKGROUND TO THE INVENTION

In conventional web inspection machines, regardless of the means of error detection, the fundamental requirement is to locate the position of an error along the length of the web, and subsequently to decelerate and stop the machine in such a manner that the error is positioned at a "splicing station" where it may be corrected by the operator. Several methods are conventionally used to achieve this requirement.

A first method, for use with unidirectional machines that cannot be reversed, involves providing a sufficient distance along the web path between the inspection zone and the splice station to enable the section of the web with the detected error to be stopped at, or prior to, the splice station. If the error passes by the splice station it cannot be brought back to the splicing area because the machine is not capable of reversing the movement of the web.

An example of such a machine is described in my U.S. Pat. No. 3,733,230, the disclosure of which is incorporated herein by reference. While the web flow path in this machine design has been used in many thousands of machines, it suffers from drawbacks with respect to the manufacturing and processing demands of industry today.

Firstly, the industry is demanding that web inspection machines be capable of handling much larger unwind rolls. Since, in the web flow path of the machine shown in FIG. 4 of U.S. Pat. No. 3,733,230, the web travels from the inspection zone around the unwind roll to reach the downstream fault splicing table at the left-hand side of the machine, making the unwind roll larger would force the machine designer to raise the inspection zone to an impractical height.

Secondly, the industry is also demanding that web inspection machines be capable of rewinding much larger rolls for later delivery in larger volumes to clients. The web path layout of the machine design shown in FIG. 4 in U.S. Pat. No. 3,733,230 also greatly limits the diameter to which finished rolls can be practically wound.

Thirdly, the operator of a web inspection machine such as shown in FIG. 4 of U.S. Pat. No. 3,733,230, after having detected a fault in the inspection zone and stopped the machine, must move from the inspection zone to the far left-hand end of the machine to remove or replace the fault. This need to move back and forth between the inspection zone and the fault splicing area can be quite time consuming, especially if there are many faults to correct in the unwind roll or in the web, which are caused during subsequent downstream imaging or converting processes or functions occurring upstream of the inspection zone.

When a reversing machine is utilized, the web can be wound back onto the unwind mandrel of the machine. However, this option is often compromised by another function of the machine, for example, in line imaging or converting or slitting of the web just prior to passing into the machine rewind. Once the web is slit, it normally cannot be reversed through the slitter. For this reason, bidirectional machines are generally only used where imaging or converting or slitting is not required. Alternatively, the slitting is done on a second (post inspection) pass at a higher cost. Also, a reversing machine can often encounter difficulties with web guiding.

A third method involves the reversed retrieval of a fault (once detected and stopped by the operator or the machine) back to a combined inspection/splicing area for fault repair without having to move the unwind roll or the rewind roll. This involves the addition of a "double festoon" which is connected in such a fashion as to deplete a long length of web from one section of the machine and to add a long length of web to another section of the machine.

An example of such a machine is described in my U.S. Pat. No. 5,727,748, the disclosure of which is incorporated herein by reference, which requires a substation of the machine to be moved in order to retrieve a previously searched for fault to a combined inspection/splicing area, as seen in FIG. 5 of U.S. Pat. No. 5,727,748.

This method requires the addition of considerable web length to the machine at very considerable machine and web cost. Also, when the shuttle mechanism of the double festoon is activated, web guiding difficulties are often encountered. Also, this method often puts unacceptable limitations on the types of materials that can be processed and the diameters from which and to which they can be processed.

When a web inspection machine has been equipped with a slitting system, or another converting function such as image printing or die cutting, it is highly desirable that the operator be able to see both the web passing through the inspection zone and the web being slit (and rewound) at the same time and in close proximity. This requires the close physical location of the inspection zone with respect to the slitting and rewinding areas of the machine. One such machine design, which is shown in FIG. 1 hereof, provides the inspection zone located in close proximity, such as above and just to the left of the slitting and rewinding areas of the machine. This allows the operator to view the web passing through the inspection zone while also being able to see the slitting and rewinding areas in the same field of view. When the operator detects a web fault in the inspection zone he stops the machine. Depending upon the running speed of the machine, the web length between the inspection zone and the splicing area, and the operator's reaction time, the fault (when the machine has come to a stop) will be located at a point between the inspection zone and the fault splicing table. Then the operator can jog the web fault forward to the splice table for fault removal or repair.

SUMMARY OF INVENTION

The present development relates to a way in which to address and solve the three main drawbacks and shortcomings of the web handling techniques of the prior art. The present invention essentially involves a juxtaposition of the inspection zone and the downstream fault splicing table during the time in which the operator has the machine in an "inspection, slitting, rewinding mode" and an alternative location for the inspection zone and its support structure with respect to the fault splicing table during the time in which the operator is performing a fault repair during a "fault splicing mode" at the fault splicing table. When in the "inspection, slitting, rewinding mode", the machine can also be performing another imaging and/or converting function between the unwind roll and the inspection zone.

When the operator decides to switch the machine from "inspection, slitting, rewinding mode" to "fault splicing mode", the inspection zone support structure is moved away from the fault splicing table location. Once the fault repair is made the operator directs the inspection zone support structure to its normal inspection location.

This invention permits the inspection zone to be located in close proximity to the slitting and rewinding areas for common viewing during normal running of the machine, but also allows the operator to repair a fault which has just been brought forward to the fault splicing table without substantially having to physically move along the machine to go from an inspection zone to a fault splicing table. Since the inspected web does not have to travel around the unwind roll to reach the fault splicing table, there is permitted the processing of very much larger unwind rolls and rewind rolls through the machine.

Accordingly, one aspect of the present invention provides a web processing machine allowing inspection and repair of a roll of web material, the machine including:

(a) an unwind mandrel (b) a rewind mandrel (c) an inspection zone (d) a splicing area (e) guide rolls for directing the web along a path from the unwind mandrel, past the inspection zone, downstream to the splicing area, to the rewind mandrel, and (f) first control means for causing the web to move past said inspection zone and said splicing area, and to allow an operator to brake the web to a standstill upon the detection of a flaw in the web; the improvement which comprises providing said machine with a retractable inspection zone including:

(g) an inspection zone support structure, (h) means to move said support structure in either or both of two planes which are parallel to the direction of travel of the web, (i) a plurality of idler rolls mounted to said support structure in said machine, and so positioned along the web between the inspection zone and the splicing area so that web material can be strung therearound in substantially boustrophedonic configuration, and (j) second control means adapted, upon detection of a flaw at the inspection zone, and upon braking of the web to a standstill, to move said support structure away from its essentially juxtaposed position with respect to the splicing area in such a fashion as to expose the splicing area for use by the operator to perform a repair, verification, or any type of modification, without having to substantially move physically from the position in which the operator was located to perform inspection while the machine was running.

In one embodiment of the invention, one or more means may be provided between the unwind mandrel and the inspection zone to effect one or more converting processes or functions, such as slitting, image printing or die cutting.

This invention, in a further aspect, provides a method of inspecting and repairing a roll of web material, for use with a machine which incorporates: an unwind mandrel; a rewind mandrel; an inspection zone; a splicing area; guide rolls for directing the web material along a path from the unwind mandrel, past the inspection zone, downstream to the splicing area, to the rewind mandrel; first control means to cause the web material to move past said inspection zone and said splicing area and to allow the web to be braked to a standstill upon the detection of a feature being searched for along the web; an inspection zone support structure; means to move said support structure in either or both of two planes which are parallel to the direction of travel of the web; and a plurality of idler rolls mounted to said support structure in said machine, the method including the steps of:

(a) stringing the web material from the unwind roll, through the inspection zone, around a plurality of idler rolls in substantially boustrophedonic configuration, through the splicing area, and eventually to the rewind mandrel;

(b) unwinding the roll of web material at the unwind mandrel, while rewinding the web material at the rewind mandrel, whereby the web material moves past the inspection zone and the splicing area;

(c) inspecting the web material at the inspection zone in order to detect a feature being searched for;

(d) when such feature is detected, using control means to brake the web material to a standstill;

(e) moving the inspection zone support structure away from its essentially juxtaposed position with respect to the splicing area, thus exposing the splicing area to access by the operator; and (f) repairing the web material.

Following repair, the inspection zone support structure is returned to the essentially juxtaposed position with respect to the splicing area and inspection of the web is resumed.

In one embodiment of the invention, one or more converting processes, such as slitting, image printing or die cutting may be effected on the web during passage from the unwind mandrel to the inspection zone.

DESCRIPTION OF PREFERRED EMBODIMENT

Figure 1:
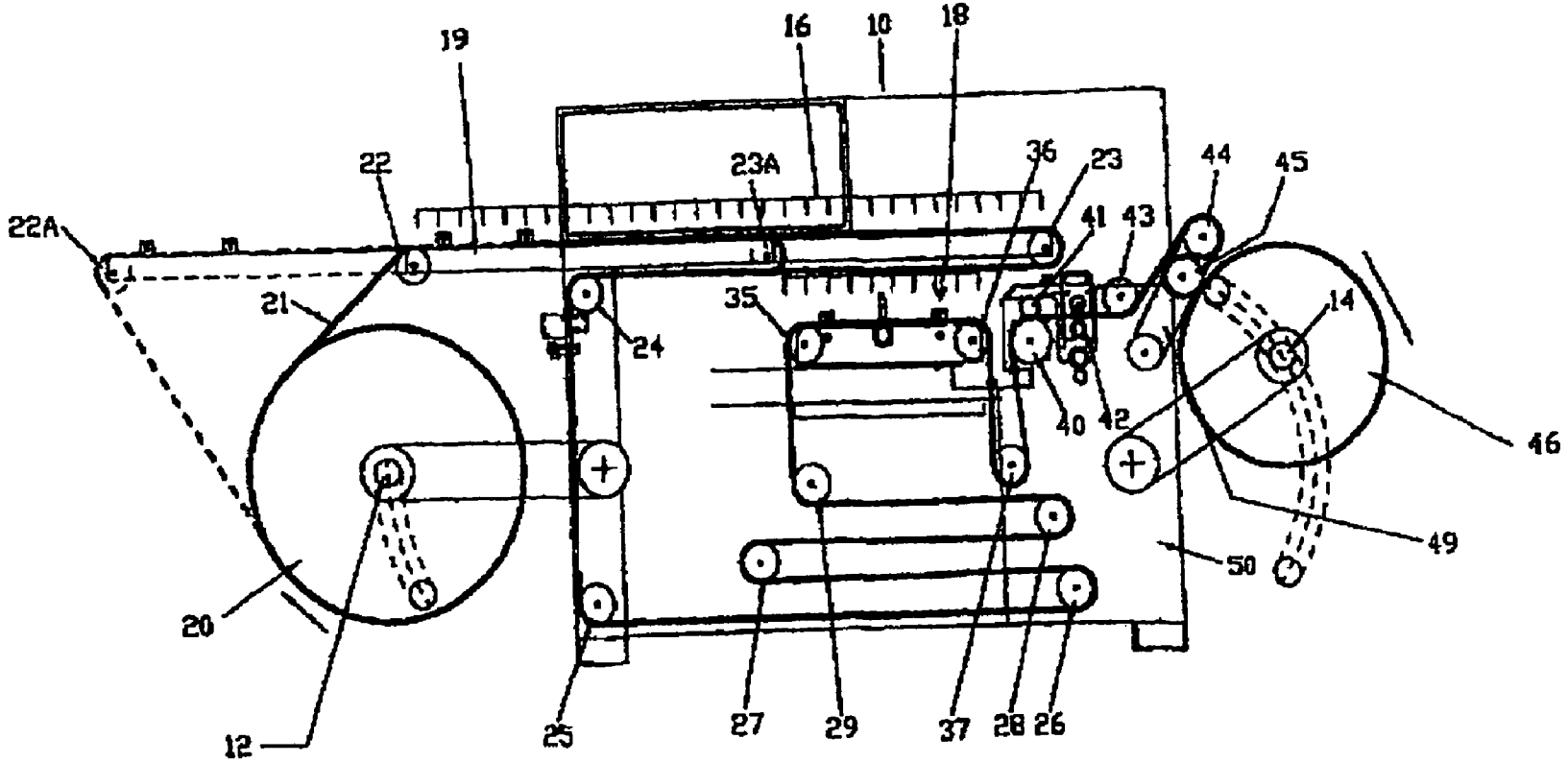
FIG. 1 is a schematic side-elevational view of a web inspection and repair machine provided in accordance with one embodiment of the invention.

Attention is first directed to FIG. 1, which is a schematic side-elevational view showing the major components of a web processing mechanism to which the present invention has been applied.

The mechanism shown generally at 10 in FIG. 1 includes an unwind mandrel 12, a rewind mandrel 14, an inspection zone 16, and a splicing area 18.

Figure 3:
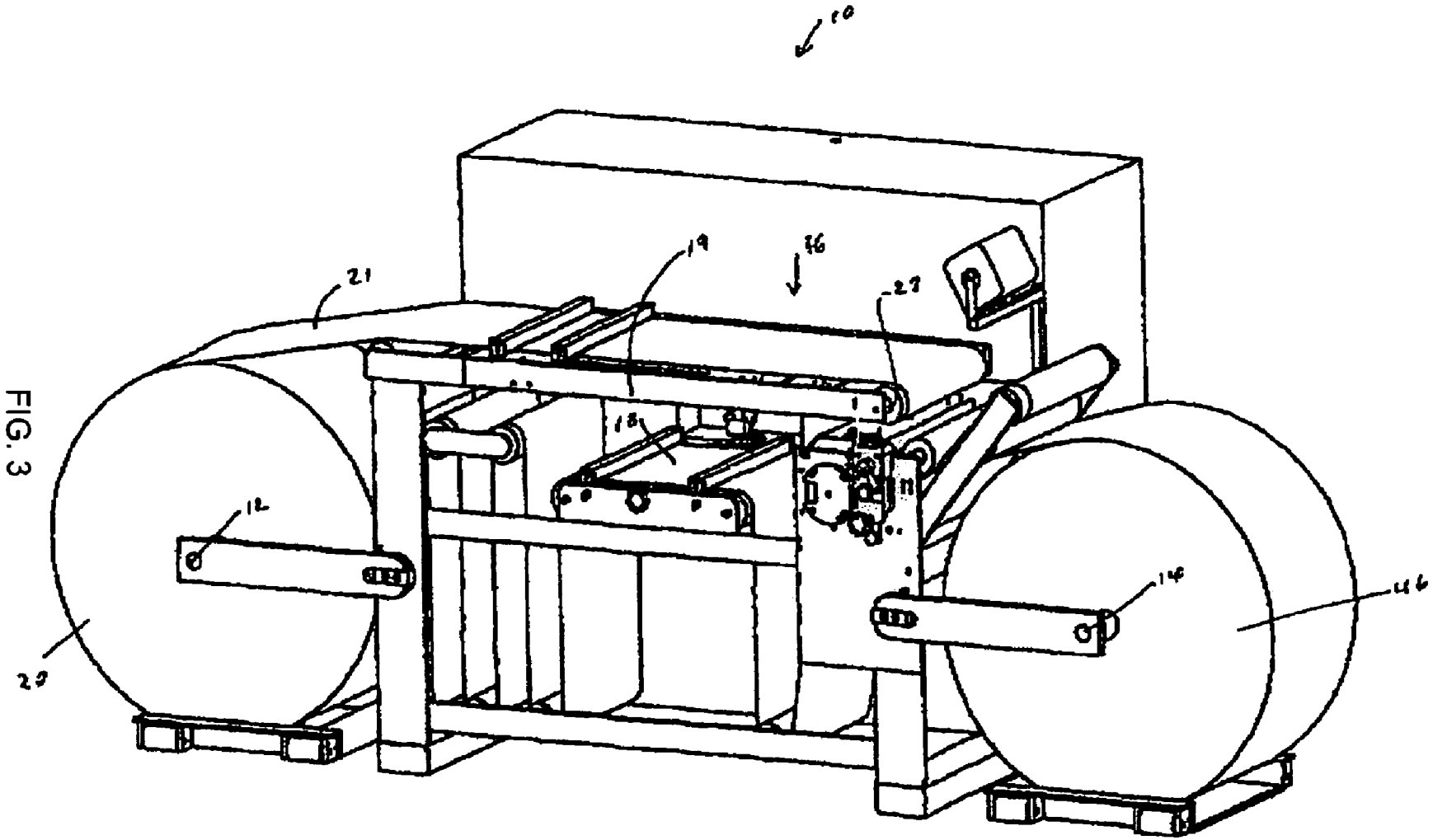
FIG. 3 is a perspective view of the web inspection and repair machine of FIG. 1 showing the machine in the "inspection, slitting and rewind" mode in which the inspection zone and its support structure is in a juxtaposed position with respect to the fault splicing area.
Figure 4:
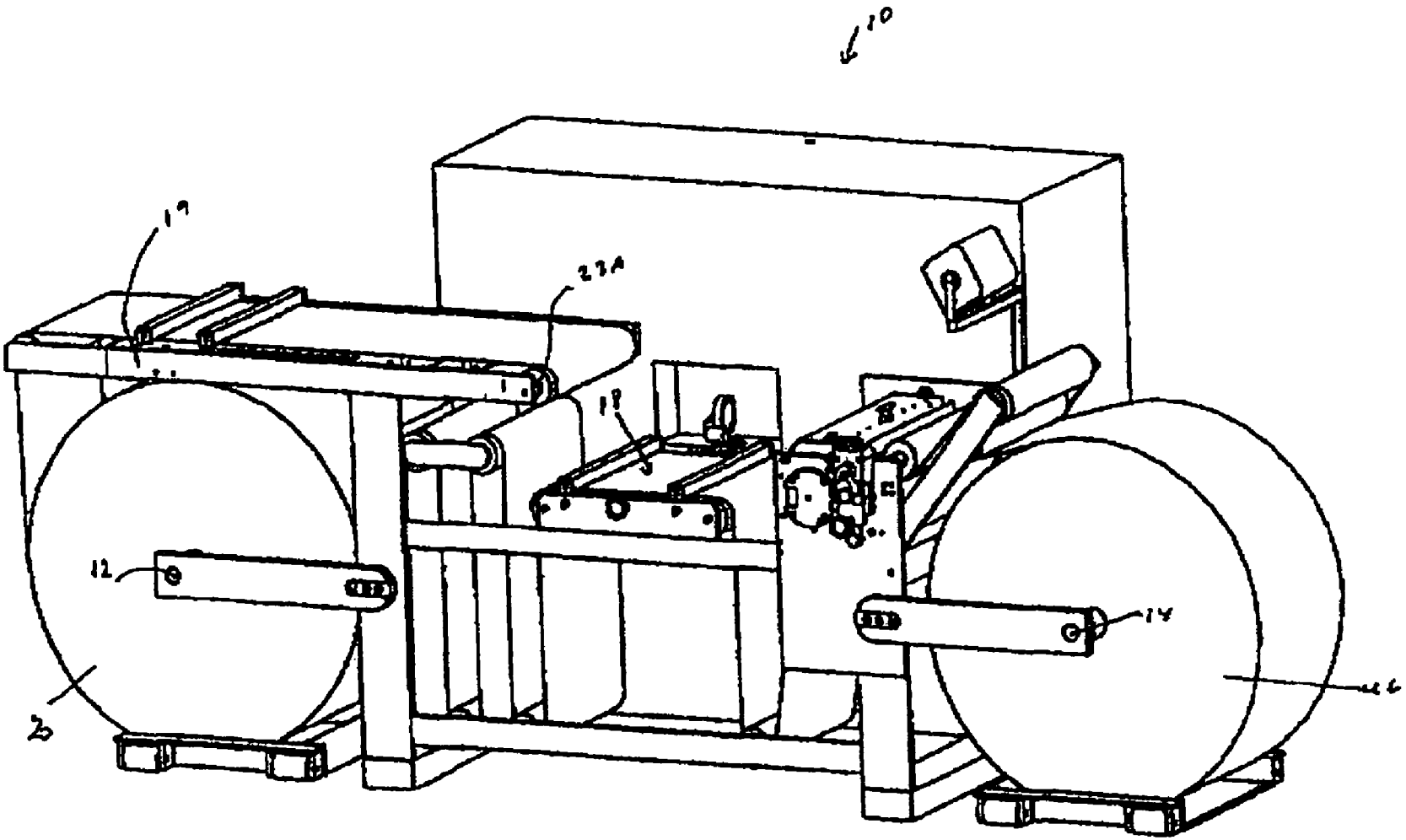
FIG. 4 is a perspective view of the web inspection and repair machine of FIG. 1 showing the machine in the "fault repair" mode in which the inspection zone and its support structure is in a retracted position with respect to the fault splicing area, so that a fault repair can be made.

A coil 20 of web material is mounted on the unwind mandrel 12, with the web 21 being paid off the coil 20. The web 21 is next threaded sequentially around rollers 22 and 23. The inspection zone 16 extends generally between rollers 22 and 23. Rollers 22 and 23 are mounted into an inspection zone support structure 19, which is movable between a first forward position (solid outline; FIG. 3) and a second rearward "retracted" position (dotted outline; FIG. 4).

The web 21 exiting the inspection zone support structure is sequentially entrained around fixed idler rolls 24, 25, 26, 27, 28 and 29. Web 21 is then entrained around idler rolls 35 and 36. The splicing area 18 extends generally between roll 35 and 36. The web 21 exiting the splicing area is entrained around an idler roll 37 and then around a draw roll 40 and between the draw roll 40 and a nip roller 41. The combination of draw roll 40 and nip roller 41 can be driven by a main motive power means (not illustrated for the machine 10) to traction the web so that it can be transferred from the unwind mandrel 12 to the rewind mandrel 14.

The web next enters a slitting mechanism 42 and is entrained around stationary idler roll 43 and then sequentially around idler rolls 44 and 45. The latter two idler rolls 44 and 45 are mounted at one end of a lever arm assembly 49 which is pivoted at the other end to a portion of the frame 50. This arrangement allows the idler rolls 44 and 45 to follow the gradually increasing diameter of the rewind coil 46, ensuring that the web is rewound with proper parallelism and tightness.

With respect to the inspection zone 16, during normal "inspection, slitting and rewinding mode" of operation of the machine 10, the inspection zone 16 is located in close proximity to the slitting section 42. This arrangement permits the operator to generally inspect web as it is passing through the inspection zone while also being able, at the same time, to watch the accuracy of slitting of the web in the slitting section 42. In addition, during the "inspection, slitting, and rewinding mode" of operation, the inspection zone 16 is located directly above the fault splicing area 18.

The inspection zone 16 and its support structure 19 are shown in FIG. 1 in solid lines in their forward rightward-most position, which corresponds to a normal operating position of the web handling machine 10 when it is in "inspection, slitting, and rewinding mode" (see also FIG. 3). The inspection zone 16 and its support structure 19 can move to a rearward leftward-most position for fault removal and repair of the web 21 in the splicing area 18. The far leftward position of the inspection zone support structure 19, including the translational movement of idler roll 22 to position 22A and idler roll 23 to position 23A, as these two idler rolls are incorporated into, and move with, the support structure, is shown in broken line in FIG. 1 (see also FIG. 4).

In the normal use of the machine shown in FIG. 1 and in perspective view in FIG. 3, the operator stands or sits at the inspection zone 16 and uses conventional control means for causing the web 21 in coil 20 to flow along the path illustrated in FIG. 1 from the coil 20 to the rewind core 46, which includes moving the web 21 past the inspection zone 16 and the splicing area 18. The inspection zone 16 is located virtually directly above the splicing area 18 in the "inspection, slitting, and rewinding mode" of operation and includes suitable means to enable the operator to detect flaws in the web, for example, a missing label in the case of the web 21 acting as a substrate for a plurality of labels. When the operator detects a flaw, he activates a conventional braking means (not illustrated in FIG. 1) to bring the velocity of the web down to a very low "creep" or "jog" speed. The operator then advances the detected web flaw to the splicing area and brakes the web to a standstill.

The operator then uses a second control means, which may be either manual or motively powered, to move inspection zone support structure 19 to the leftward position which is shown by the broken lines in FIG. 1 and shown in perspective view in FIG. 4. The operator can then attend to the fault removal and splicing task. When the splicing has been completed, the operator can move the inspection zone support structure 19 back into the rightward position, close to the slitting station 42 and begin the inspection, slitting, and rewinding procedure again.

The operator, after having detected a fault in the inspection zone 16, has not had to substantially move physically along the machine 10 in order to bring the fault to the splicing area 18 and to subsequently make a repair. Neither does the operator have to substantially then move in order to return the operation of the machine to the "inspection, slitting, and rewinding mode" and to view the web in the inspection zone 16, because the operator only needs to return the inspection zone support structure 19 substantially to its rightward position so that the operator can begin running the machine again.

Though not illustrated, the inspection zone support structure 19 may be mounted on rails or the like, and positioned manually by the operator, by an air or hydraulic cylinder, a ball screw, or similar actuating device.

Figure 2:
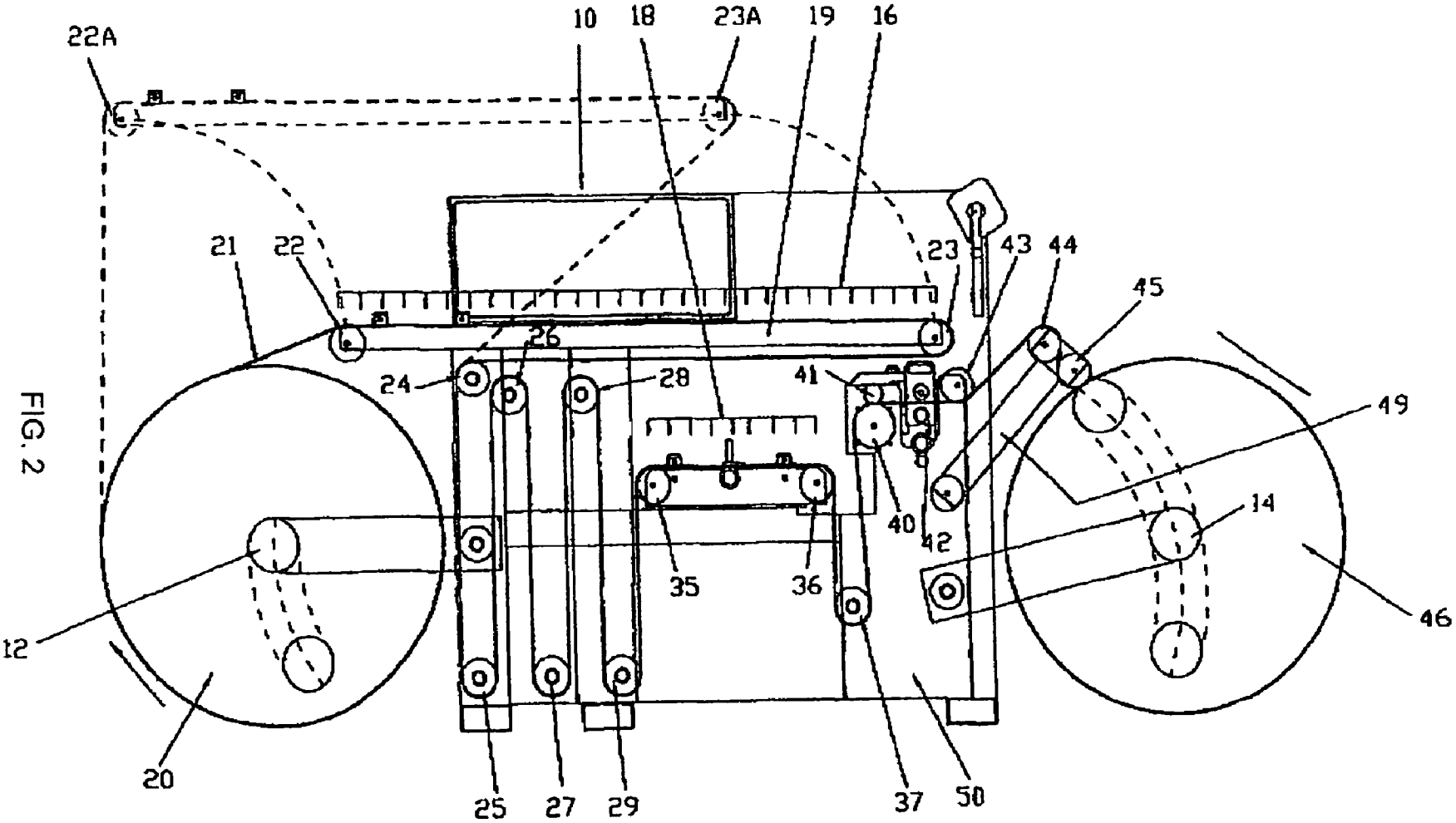
FIG. 2 is a schematic side-elevational view of a web inspection and repair machine provided in accordance with another embodiment of the invention.

FIG. 2 is a side elevational view of another embodiment of the invention which utilizes the same reference numerals as FIG. 1 to describe the same elements. In FIG. 2, instead of the inspection zone support structure 19 moving horizontally between the forward and rearward positions, the inspection zone support structure 19 is moved upwardly and away from its normal operating position (solid outline) to a location spaced from the machine 10 (dotted outline).

Figure 5:
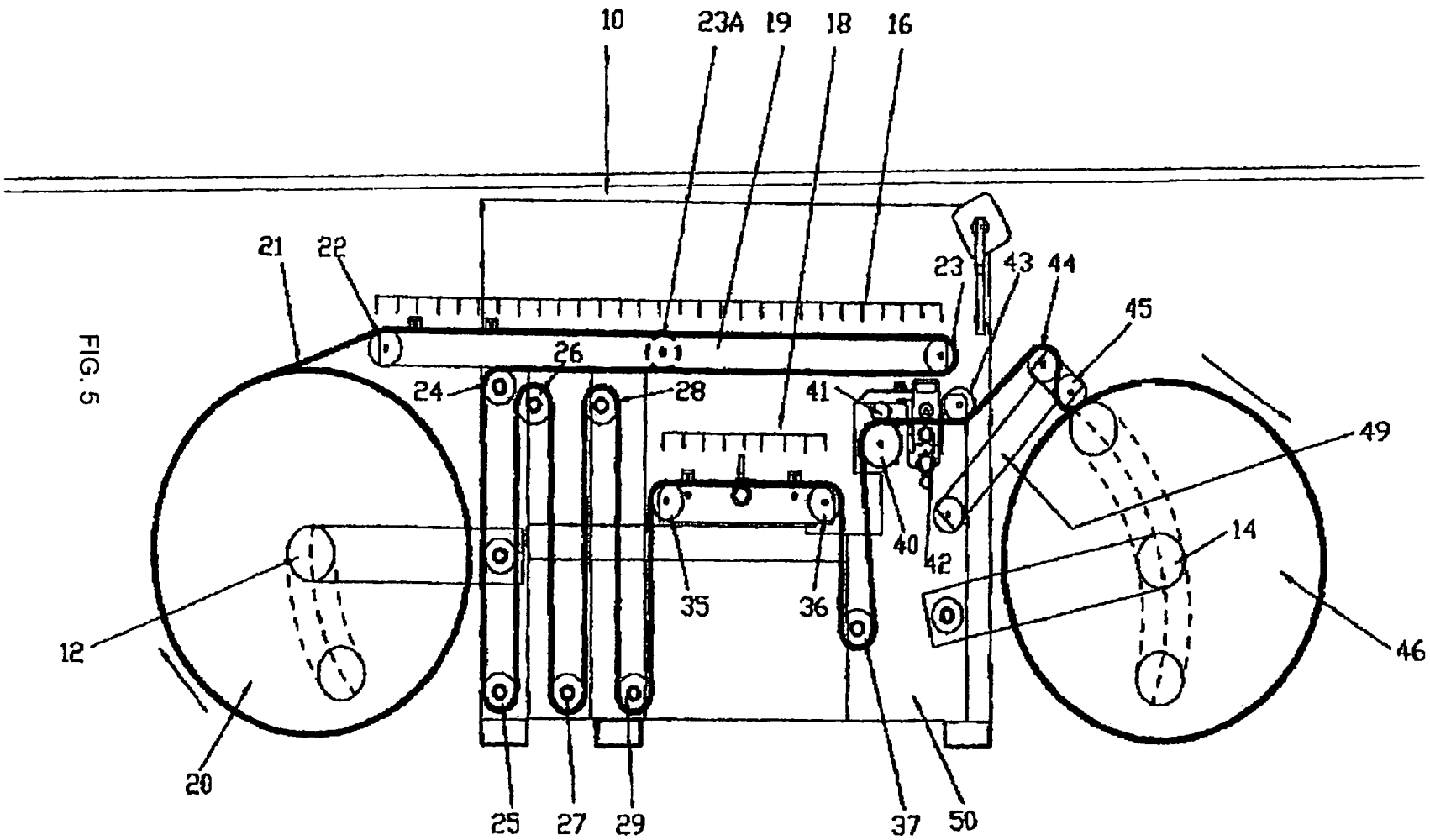
FIG. 5 is a schematic side elevational view of a web inspection and repair machine provided in accordance with another embodiment of the invention.

FIG. 5 is a side elevational view of an additional embodiment which utilizes the same reference numerals as used in FIGS. 1 and 2 to describe the same elements. In FIG. 5, instead of the inspection zone 16 moving horizontally between forward and rear positions, the inspection zone 16 is in the form of two telescoping inspection zone elements 16' and 16", each having respective support structures 19' and 19" (see FIG. 6).

Figure 6:
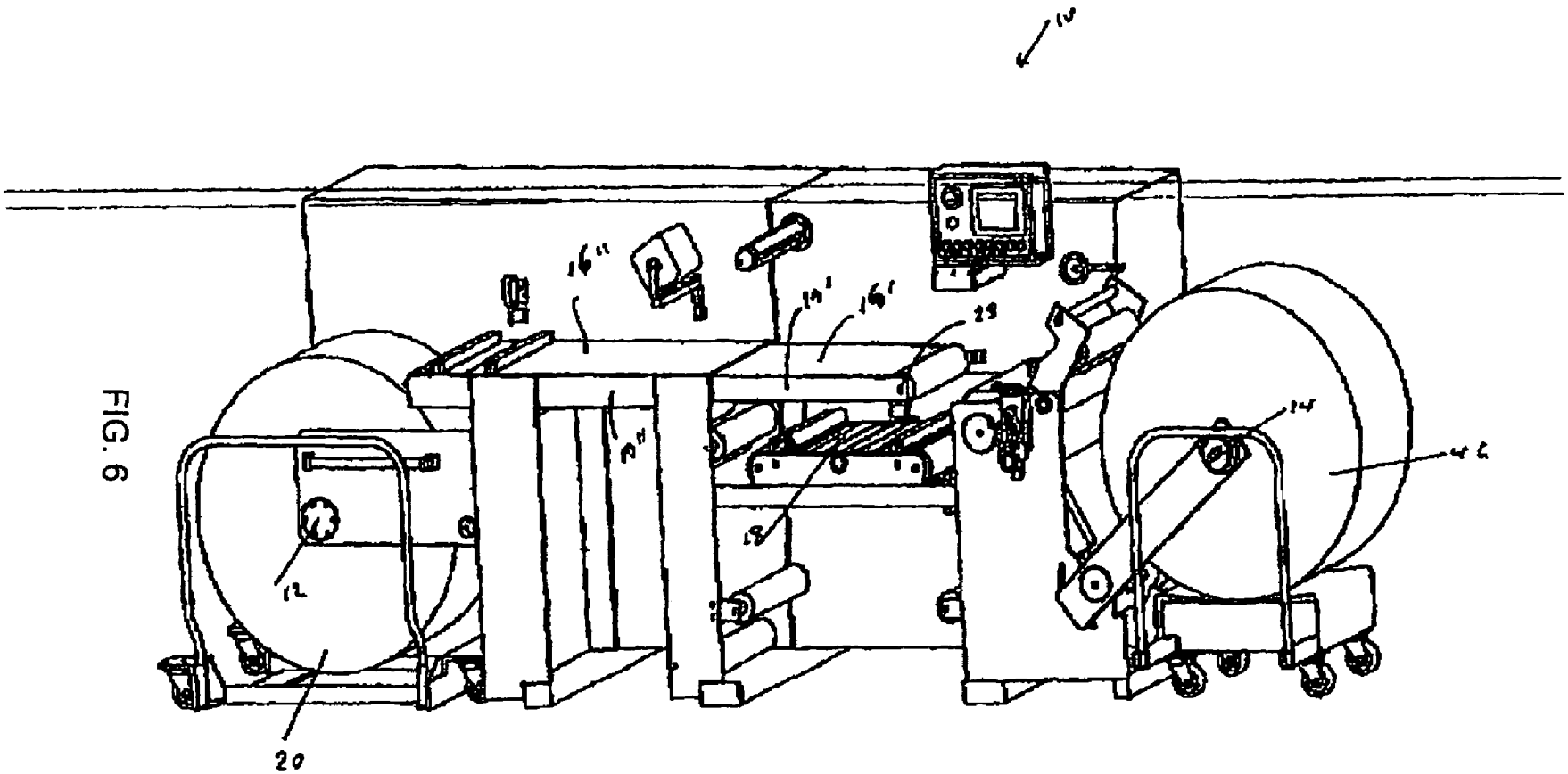
FIG. 6 is a perspective view of the web inspection and repair machine of FIG. 5 showing the machine in the "inspection, slitting and rewind mode" in which the inspection zone and its support structure is in a juxtaposed position with respect to the fault splicing area.
Figure 7:
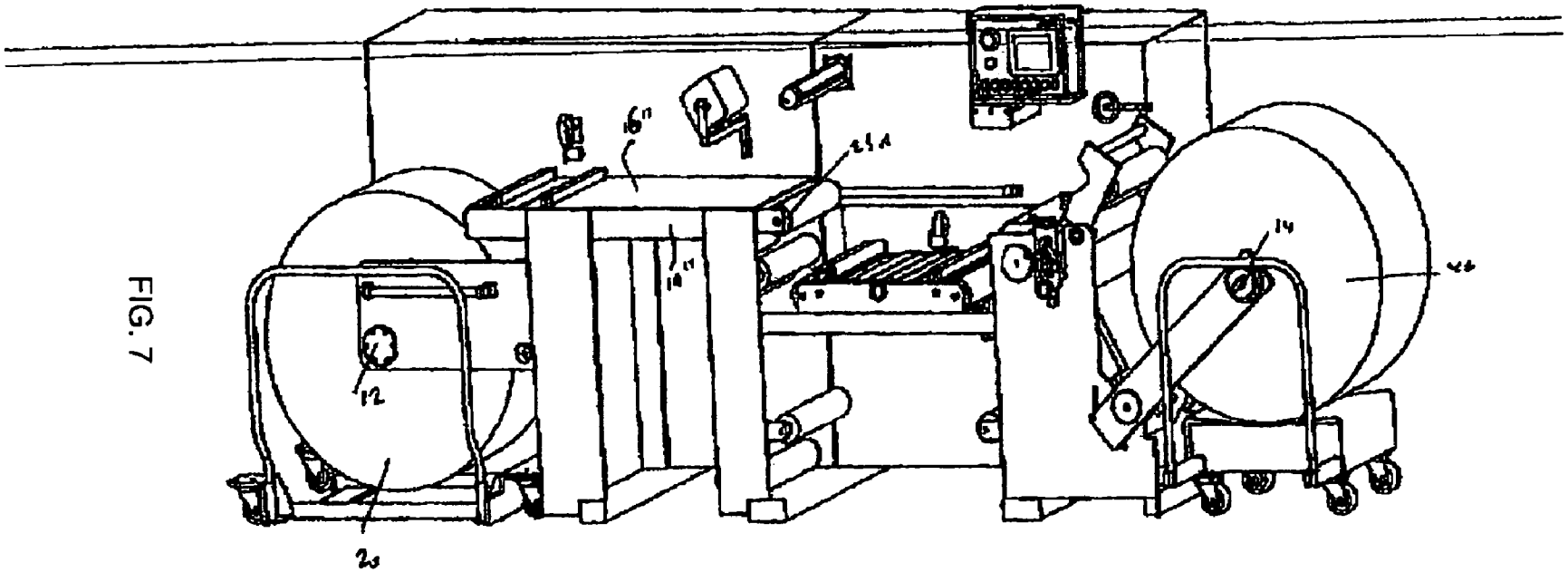
FIG. 7 is a perspective view of the web inspection and repair machine of FIG. 5 showing the machine in the "fault repair mode" in which the inspection zone and its support is in the retracted position with respect to the fault splicing area.

During normal "inspection, slitting and rewinding mode" of operation, the inspection zone 16' and the associated moveable support structure 19' is in the rightward position (solid line; see FIG. 6). The inspection zone element 16' and its associated moveable support structure 19' can retract into the inspection zone element 16" with associated fixed support structure 19" for fault removal and repair of the web 21 in the splicing area 18. The far leftward position of the inspection zone element 16' including translational movement of the idler roller 23 to position 23A, is shown in outline in FIG. 5 and in FIG. 7.

The embodiment of FIG. 5 is utilized in the same manner as the embodiment described above with respect to FIG. 1.

The configuration and devices illustrated herein, allowing the close juxtaposition of an inspection zone and a sufficiently downstream splicing area such that the inspection zone can be separated physically from the splicing area in such a way as to allow the operator to ergonomically attend to a fault repair, are applicable to various kinds of the machines, such as inspectors, die cutters, printing machines and other types of web converting machines.

Figure 8:
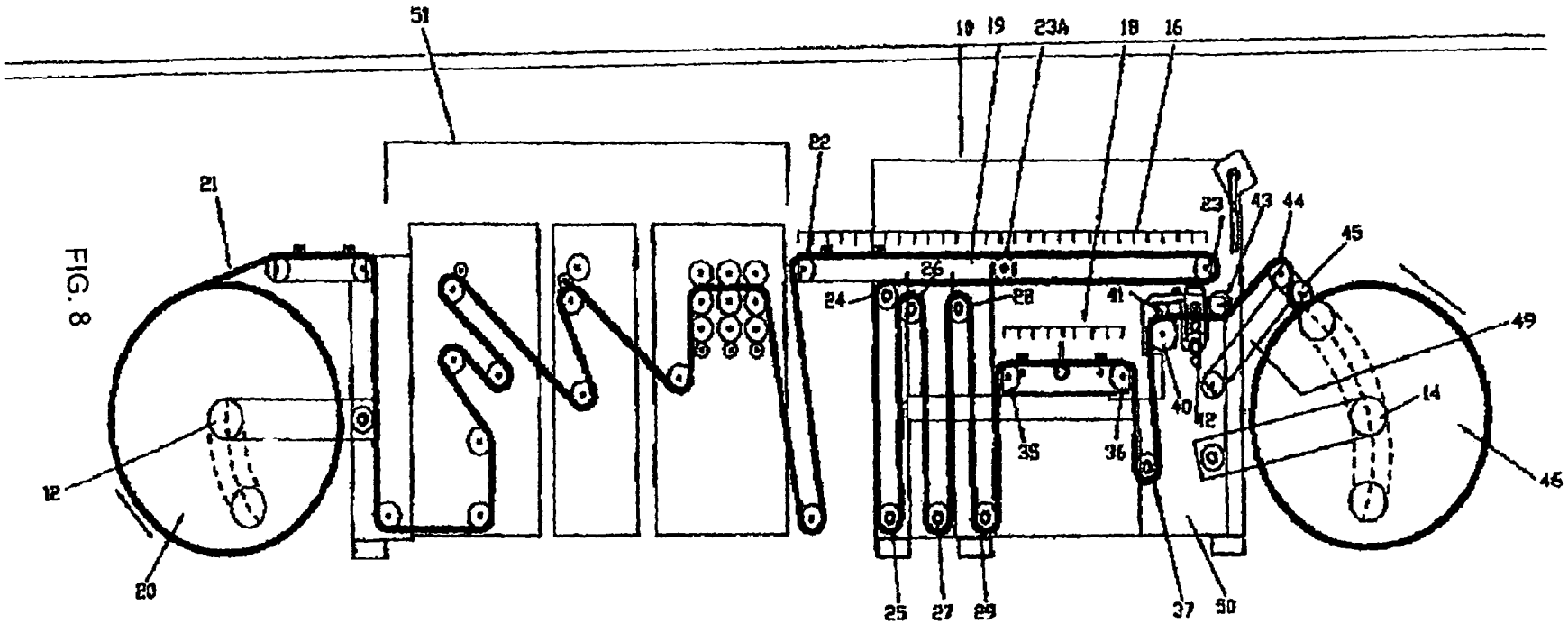
FIG. 8 is a schematic side elevational view of a web inspection and repair machine having the arrangement shown in FIG. 5 and which incorporates a printing or imaging station and/or converting station, such as die cutting, located between the unwind roll and the inspection zone.

FIG. 8 is a side elevational view of such a device. A printing or imaging station 51 and/or converting means, such as die cutting, is located between the roll of web material 20 and the remainder of the web inspection and repair machine in accordance with the embodiment of FIGS. 5 to 7 described above.

SUMMARY OF DISCLOSURE

In summary of this disclosure, the present invention relates to a novel arrangement in a web processing machine which allows for the use of larger web rolls and which overcomes the problems of the prior art. While several embodiments of this invention have been illustrated in the accompanying drawings and described hereinabove, it will be evident to those skilled in the art that changes and modifications may be made therein, without departing from the essence of this invention.

What I claim is:

1. A web processing machine allowing inspection and repair of a roll of web material, the machine comprising:

(a) an unwind mandrel for receiving a roll of web material for processing, (b) a rewind mandrel for receiving a roll of processed web material, (c) an inspection zone for inspecting web passing from said unwind mandrel to said rewind mandrel, (d) a splicing zone for splicing repair of at least one flaw in the web passing from the unwind mandrel to said rewind mandrel, (e) guide rolls for directing the web along a path from the unwind mandrel, past the inspection zone, downstream to the splicing zone, and to the rewind mandrel, (f) first control means for causing the web to move past said inspection zone and said splicing zone and to allow an operator to brake the web to a standstill upon the detection of a flaw in the web, and wherein said inspection zone is retractable from a position substantially juxtaposed to said splicing zone and comprises:

(i) an inspection zone support structure, (ii) a plurality of idler rolls mounted to said support structure in said machine, and so positioned along the web between the inspection zone and the splicing area so that web material can be strung therearound in substantially boustrophedonic configuration, and (iii) control means adapted, upon detection of a flaw at the inspection zone, and upon braking of the web to a standstill, to move said support structure away from its substantially juxtaposed position with respect to the splicing area in such a fashion as to expose the splicing area for use by the operator to perform a repair, verification, or any type of modification, without having to substantially move physically from the position in which the operator was located to perform inspection while the machine is running.

2. The web processing machine of claim 1 further including means located between said unwind mandrel and the inspection zone to effect at least one converting function on said web.

3. The web processing machine of claim 2 wherein said converting function is at least one of slitting, image printing and die cutting of the web.

4. The web processing machine of claim 1 wherein said inspection zone is retractable by moving said support structure as a single unit in a single plane between a first extended position to a retracted position in which the splicing zone is exposed.

5. The web processing machine of claim 1 wherein said inspection zone is retractable by lateral movement of a first retractable inspection zone element, into a fixed second stationary inspection zone element to expose the splicing zone.

6. A method of inspecting and repairing a roll of web material, for use with a machine which comprises: an unwind mandrel; a rewind mandrel; an inspection zone; a splicing zone; guide rolls for directing the web material along a path from the unwind mandrel, past the inspection zone, downstream to the splicing zone, to the rewind mandrel; first control means to cause the web material to move past said inspection zone and said splicing zone and to allow the web to be braked to a standstill upon the detection of a feature being searched for along the web; an inspection zone support structure retractable from a position substantially juxtaposed to said splicing zone; and a plurality of idler rolls mounted to said support structure in said machine, the method comprising the steps of:

(a) stringing the web material from the unwind roll, through the inspection zone, around a plurality of idler rolls in substantially boustrophedonic configuration, through the splicing zone, and to the rewind mandrel;

(b) unwinding the roll of web material at the unwind mandrel, while rewinding the web material at the rewind mandrel, whereby the web material moves past the inspection zone and the splicing zone;

(c) inspecting the web material at the inspection zone in order to detect a feature being searched for;

(d) when such feature is detected, using control means to brake the web material to a standstill;

(e) moving the inspection zone support structure away from its essentially juxtaposed position with respect to the splicing zone, thus exposing the splicing zone to access by the operator; and (f) repairing the web material.

7. The method of claim 6 including at least one converting function effected on the web during passage from the unwind mandrel to the inspection zone.

8. The method of claim 7 wherein said at least one converting function comprises at least one of slitting, image printing and die cutting of the web.

* * * * *